US008230971B2

(12) United States Patent
Wiseman et al.

(10) Patent No.: US 8,230,971 B2
(45) Date of Patent: Jul. 31, 2012

(54) LADDER SUPPORT APPARATUS

(76) Inventors: Cecil Wiseman, Wards River (AU); Christopher Wiseman, Wards River (AU)

( * ) Notice: Subject to any disclaimer, the term of this patent is extended or adjusted under 35 U.S.C. 154(b) by 199 days.

(21) Appl. No.: 12/733,213

(22) PCT Filed: Aug. 15, 2008

(86) PCT No.: PCT/AU2008/001184

§ 371 (c)(1),
(2), (4) Date: Feb. 16, 2010

(87) PCT Pub. No.: WO2009/023899

PCT Pub. Date: Feb. 26, 2009

(65) Prior Publication Data

US 2010/0140017 A1 Jun. 10, 2010

(30) Foreign Application Priority Data

Aug. 17, 2007 (AU) ..... 2007904450
Oct. 12, 2007 (AU) ..... 2007905613

(51) Int. Cl.
*E06C 7/48* (2006.01)

(52) U.S. Cl. ..... 182/107

(58) Field of Classification Search ..... 182/107, 182/214

See application file for complete search history.

(56) References Cited

U.S. PATENT DOCUMENTS

| | | | | |
|---|---|---|---|---|
| 296,145 | A * | 4/1884 | Davis | 182/163 |
| 2,806,723 | A * | 9/1957 | Fairclough | 403/104 |
| 3,318,416 | A * | 5/1967 | Robinson | 182/214 |
| 3,910,378 | A * | 10/1975 | Nyman | 182/103 |
| 5,383,533 | A * | 1/1995 | Nikula et al. | 182/107 |
| 6,044,930 | A * | 4/2000 | Hayman | 182/206 |
| 7,219,766 | B2 * | 5/2007 | Deuer | 182/206 |
| 7,222,892 | B2 * | 5/2007 | Guidetti | 292/306 |
| 2003/0124394 | A1 * | 7/2003 | Girardie | 428/701 |
| 2006/0272894 | A1 | 12/2006 | Hein et al. | |

FOREIGN PATENT DOCUMENTS

| | | | |
|---|---|---|---|
| EP | 1498571 | A1 | 1/2005 |
| FR | 2410723 | A1 | 6/1979 |
| GB | 363510 | A | 12/1931 |
| WO | WO 2004/097154 | A1 | 11/2004 |

* cited by examiner

*Primary Examiner* — Alvin Chin Shue
(74) *Attorney, Agent, or Firm* — Morriss O'Bryant Compagni

(57) ABSTRACT

A ladder support apparatus, the apparatus including a support body, one or more clamp mechanisms operatively mountable to the support body, for mounting the support body to a structure and a retention assembly operatively connected to the support body and, in use, being adapted to limit relative movement between the ladder and ladder support, the or each clamping mechanism including a clamp aπn mounted for movement relative to the support body in a clamping direction and a release direction, an actuator operable to control the operation of the clamp arm, the clamp mechanism being arranged so as to be able to adopt a preset mode in which the clamp arm is substantially freely moveable in both the clamping direction and the release direction, a set mode in which the clamp arm is inhibited from movement in either direction but can be moved incrementally by operation of the actuator and a pre-release mode in which the clamp arm is inhibited from movement in either direction but upon operation of the actuator when in the pre-release mode the clamp arm can return to its preset mode.

10 Claims, 17 Drawing Sheets

FIG. 7
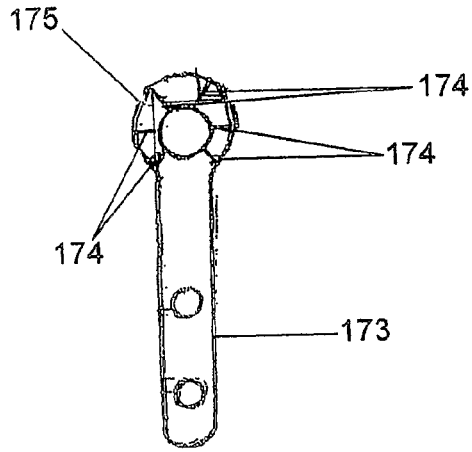
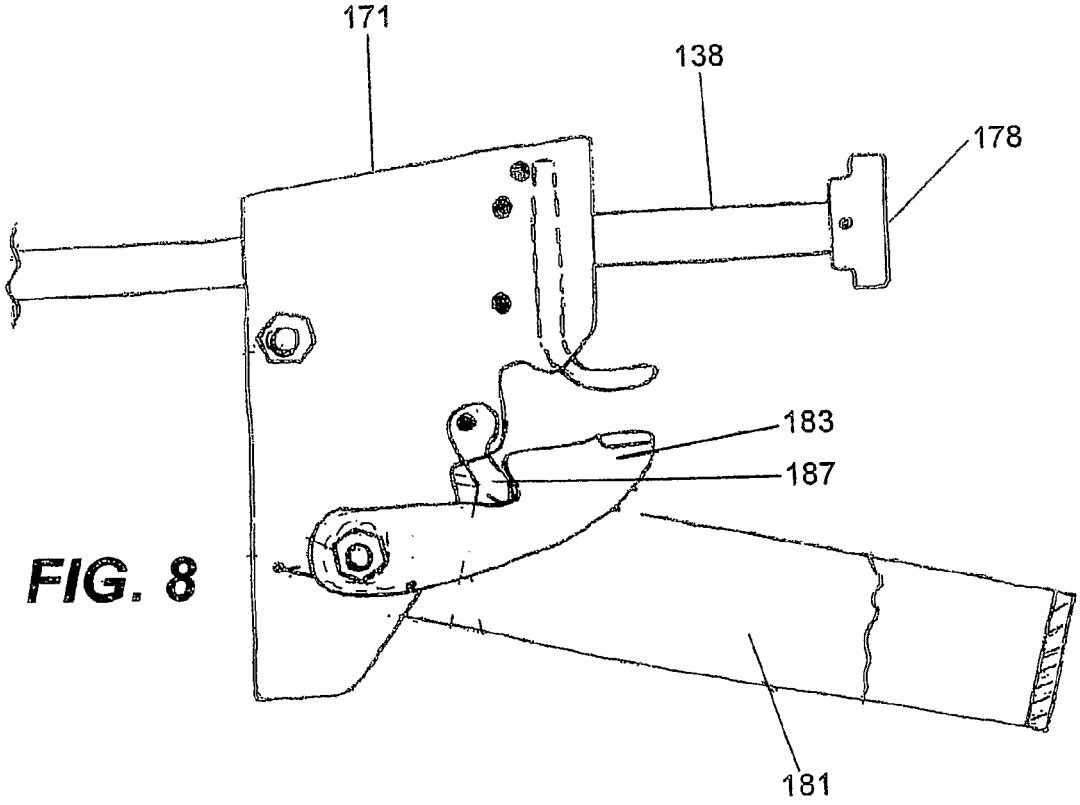
FIG. 8

LADDER SUPPORT APPARATUS

TECHNICAL FIELD

The present invention relates to apparatus for supporting a ladder when in use.

In use ladders are often arranged to lean against a wall or other part of a structure such as a building. This arrangement can often lead to situations where the user is put at risk through the danger of the ladder falling.

The present invention seeks to ameliorate the abovementioned disadvantage.

SUMMARY OF THE INVENTION

According to one aspect of the present invention there is provided a ladder support apparatus, the apparatus including a support body, one or more clamp mechanisms operatively mountable to the support body, for mounting the support body to a structure and a retention assembly operatively connected to the support body and, in use, being adapted to limit relative movement between the ladder and ladder support, the or each clamping mechanism including a clamp arm mounted for movement relative to the support body in a clamping direction and a release direction, an actuator operable to control the operation of the clamp arm, the clamp mechanism being arranged so as to be able to adopt a preset mode in which the clamp arm is substantially freely moveable in both the clamping direction and the release direction, a set mode in which the clamp arm is inhibited from movement in either direction but can be moved incrementally by operation of the actuator and a pre-release mode in which the clamp arm is inhibited from movement in either direction but upon operation of the actuator when in the pre-release mode the clamp arm can return to its preset mode.

The retention assembly may include two ladder retention devices each adapted for association with a respective ladder stile each device including a bracket which is operatively connected to the support body and includes a plurality of guides arranged in spaced apart relation for receiving the ladder stile with which it is associated therebetween, the guides being arranged to enable relative movement between the ladder and the retention devices in the direction of the stiles but inhibiting relative lateral movement. Preferably the position of the guides is adjustable relative to one another. Preferably each clamp arm is mounted for relative linear movement with respect to the support body towards the support body in the clamping direction and away from the support body in the release position.

Each clamping mechanism includes a braking device which can provide resistance to the movement of the clamp arm. A control arm may be provided which is operable to engage the braking bar towards the braking bar into a non-braking position. In one form the actuator comprises a lever pivotally mounted so that pivotal movement thereof can cause the clamping mechanism to operate in its various modes.

A lift mechanism may be provided, attached to the support body for lifting the apparatus into a selected position on the ladder. The lift mechanism may be of any suitable form, however, in one preferred form the lift mechanism includes a flexible line such as a cable or rope operatively connected to the support body. A lift eye may be connected to the support body for the purpose of connecting the lift cable or rope.

A pulley may be provided to raise the support body, along the ladder. In a preferred form the line is passed once over an upper rung of the ladder and drawn upwards by pulling downward on an appropriate end of the line at a selected purchase such as for example a 1:1 purchase.

BRIEF DESCRIPTION OF THE DRAWINGS

Preferred embodiments of the invention will hereinafter be described with reference to the accompanying drawings, and in those drawings:

FIG. 7 is an end view of part of the apparatus;

FIG. 8 is a schematic side view of the apparatus shown in FIG. 6 in a mode of operation;

DETAILED DESCRIPTION OF THE PREFERRED EMBODIMENTS

Figure 1:
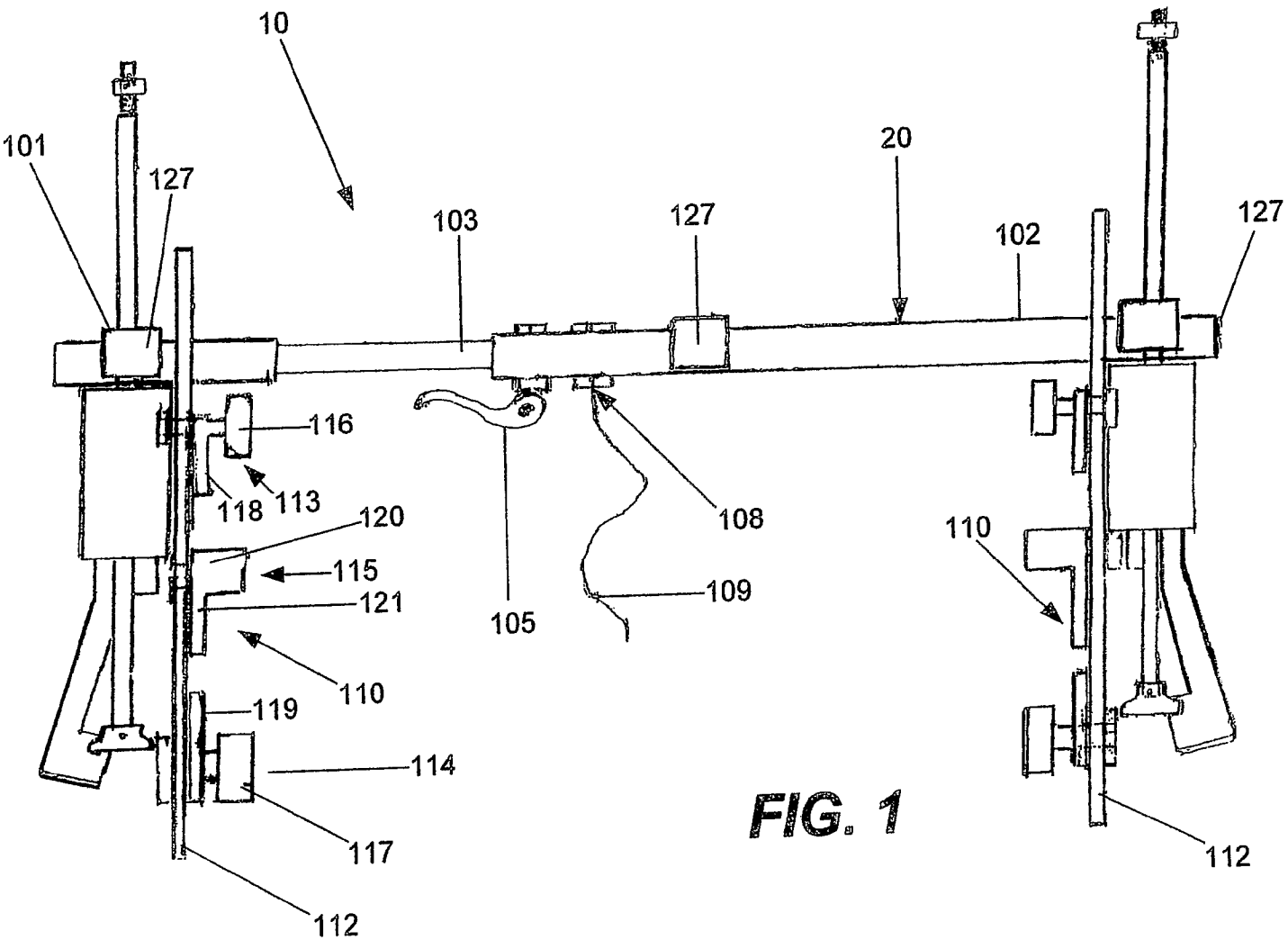
FIG. 1 is a plan view of apparatus in accordance with one embodiment of the invention.
Figure 2:
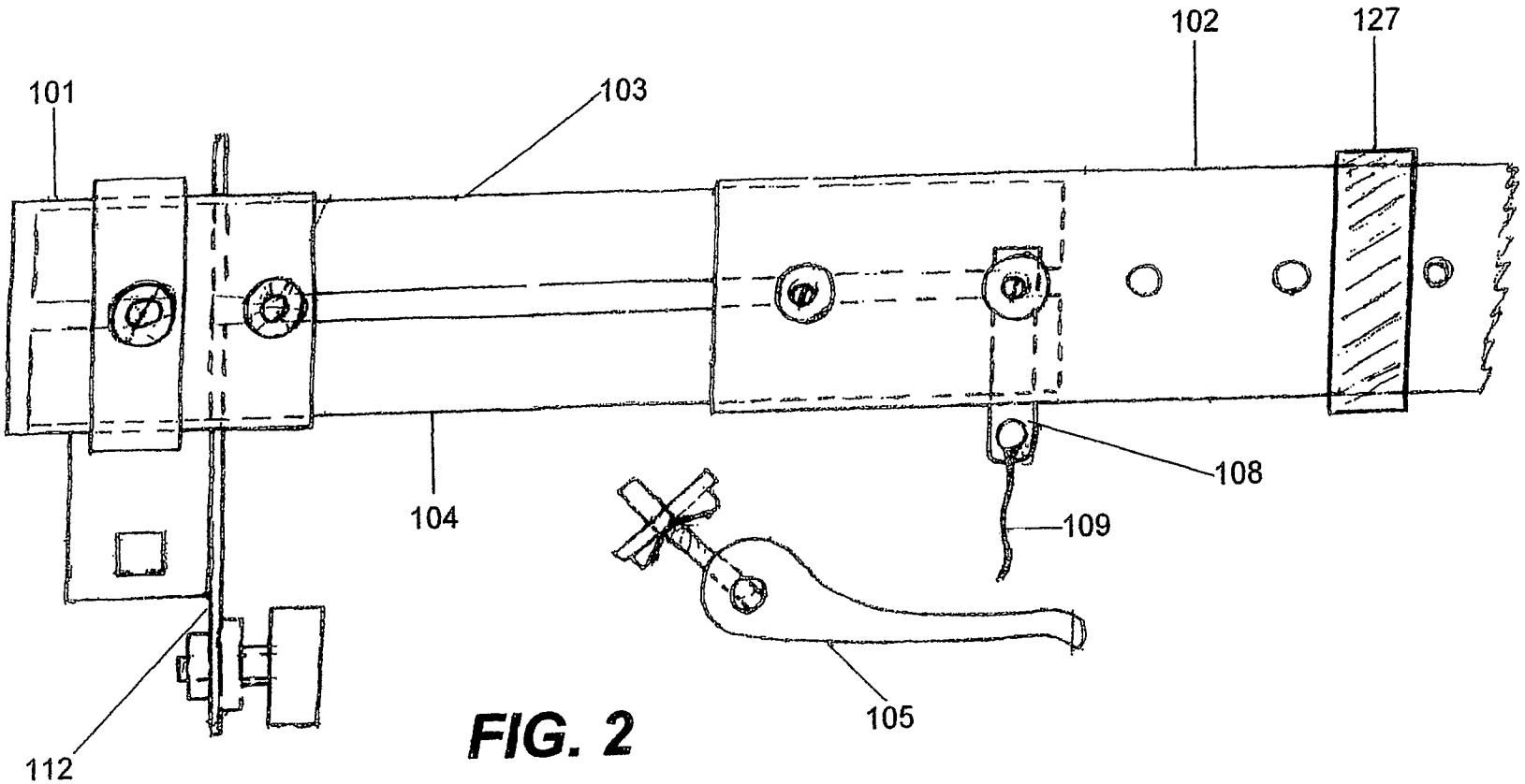
FIG. 2 is a detailed view of part of the apparatus shown in FIG. 1.
Figure 3:
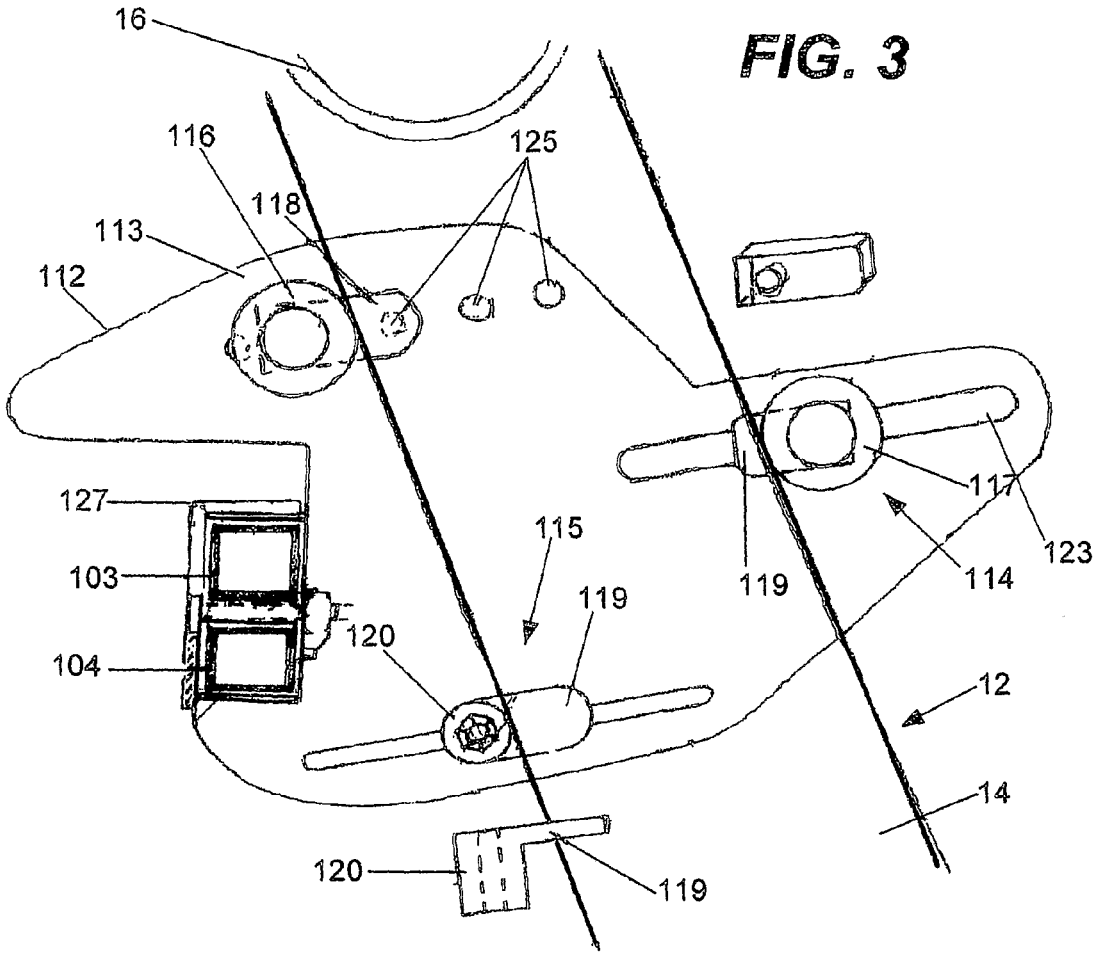
FIG. 3 is a schematic view of part of the apparatus shown in FIG. 1.
Figure 4:
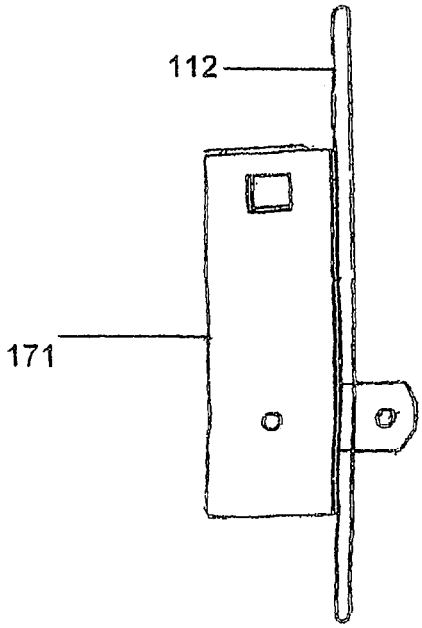
FIG. 4 is an end view of part of the apparatus shown in FIG. 3.
Figure 6:
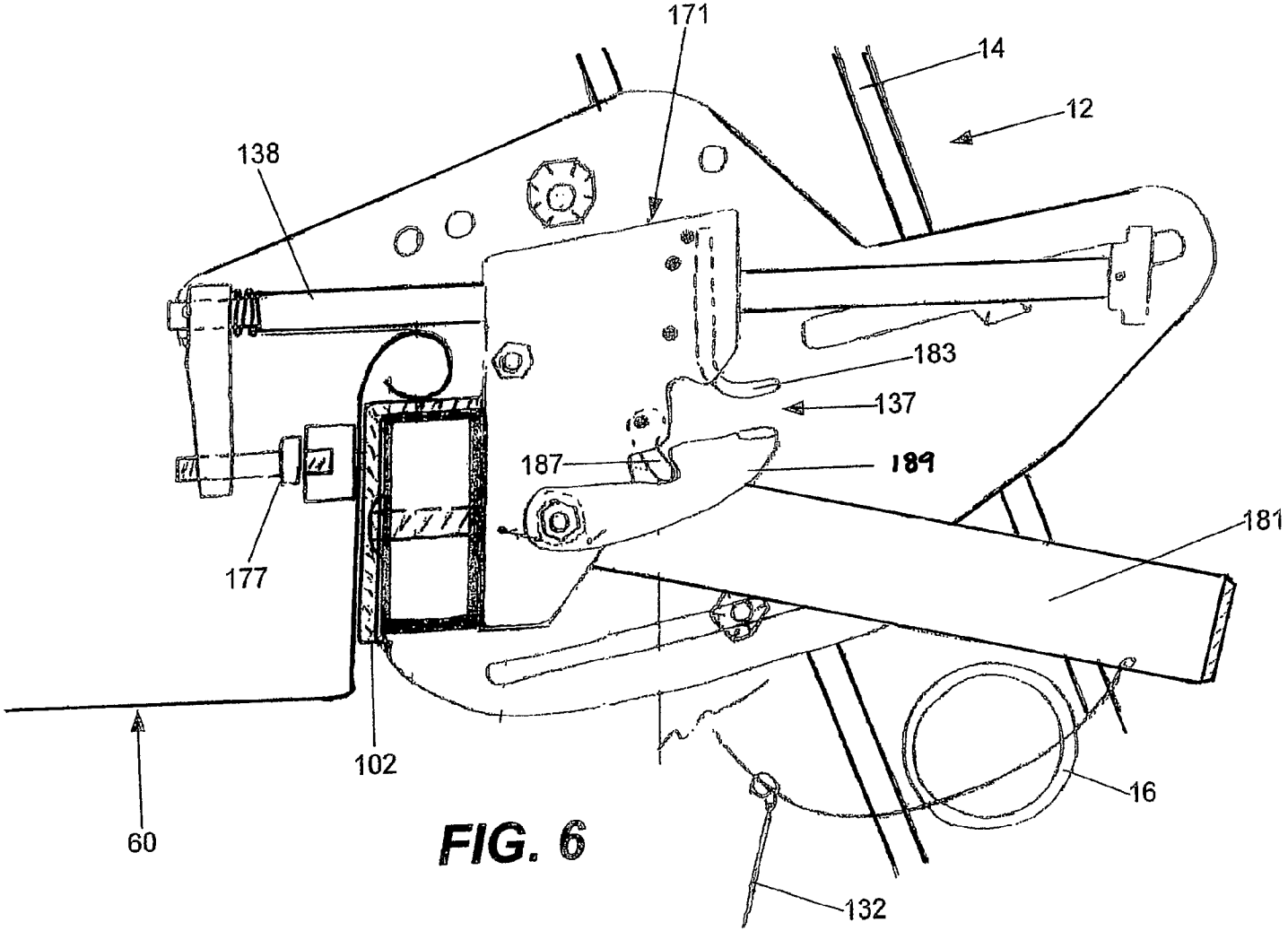
FIG. 6 is a schematic side elevation of the apparatus shown in FIG. 5 in another operating mode.
Figure 11:
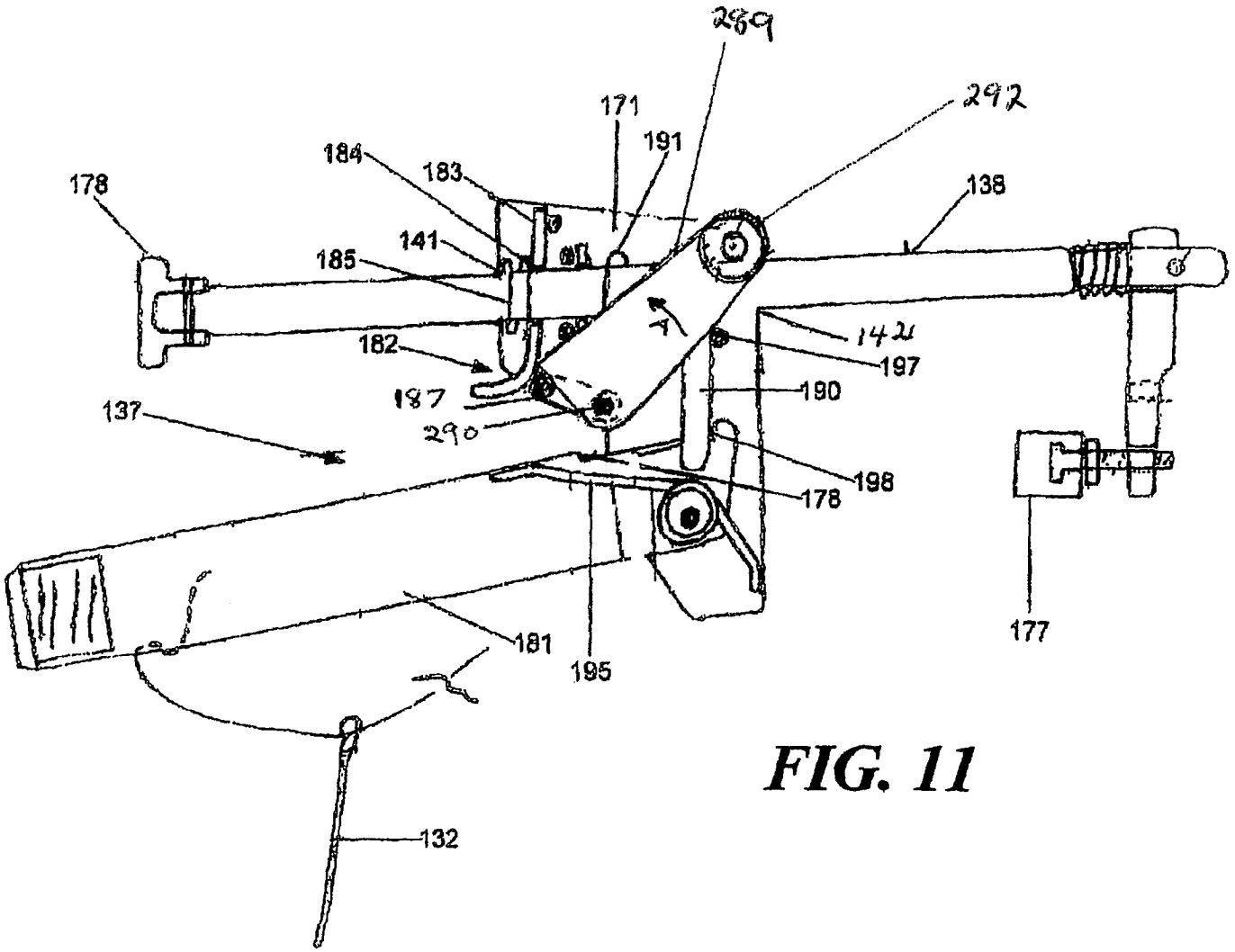
FIG. 11 is a schematic side elevation of apparatus according to another embodiment in one operating mode.
Figure 12:
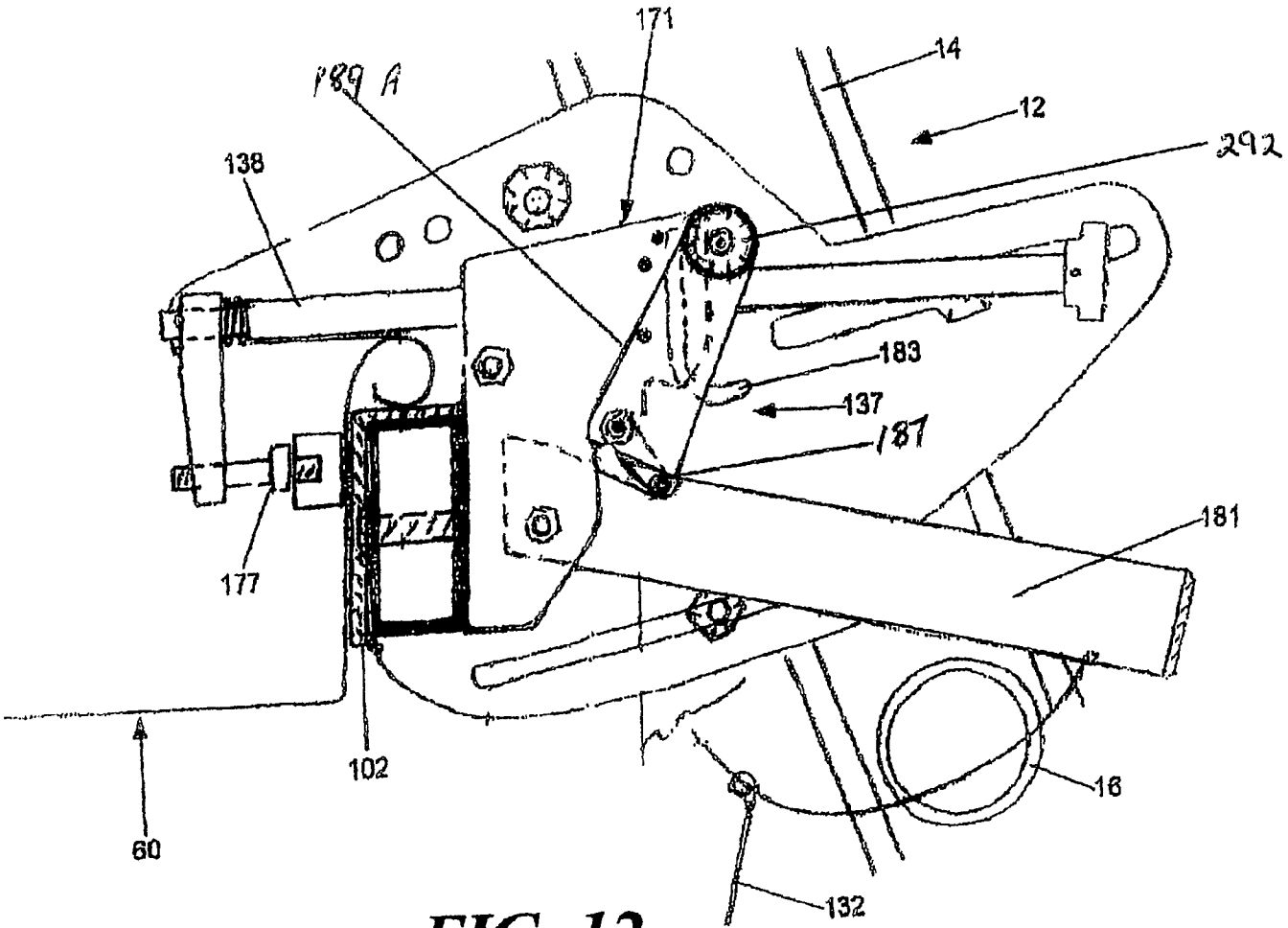
FIG. 12 is a schematic side elevation of the apparatus shown in FIG. 1 in another operating mode.

Referring to FIGS. 1 and 2 of the drawings there is shown a ladder support apparatus generally indicated at 10. As illustrated in FIGS. 3, 6 and 11 the apparatus is adapted to be mounted to a ladder 12 which includes a pair of spaced apart substantially parallel stiles 14 with spaced apart rungs 16 extending therebetween. The apparatus is adapted to be clamped to a structure such as gutter 60 (FIG. 6), scaffold member 260 (FIG. 11), or any other suitable structure. The apparatus is adapted to limit the movement of the ladder when mounted thereto.

The apparatus 10 includes a support body 20 in the form of an elongated structure which when the apparatus is mounted to a ladder extends in a direction from one stile to the other and generally parallel to the rungs.

As best illustrated in FIG. 2 the support body comprises a plurality of tubular components including outer sections 101 and 102 and inner sections 103 and 104. Outer section 101 is smaller in length than section 102 and is adapted to support inner sections 103 and 104 which are arranged generally parallel to one another and in slightly spaced apart relation. Outer section 102 is adapted to receive inner sections 103 and 104 in telescopic fashion so that they can be slidably displaced therealong so as to provide for an adjustment of the length of the support body. The support body further includes a quick release locking device 105 which holds the sections in a fixed position relative to one another. The locking device 105 is adapted to cooperate with holes in the support body. A lifting link or eye 108 is provided to which a flexible line such as a rope or cord 109 can be attached. The lifting link 108 can be positioned in one of the holes 111 (only two are itemised) chosen so that the link is centrally disposed when the length of telescopic body is adjusted. Non-slip rubber pads 127 are provided in spaced apart relation along the body which inhibit damage to which the apparatus is to be clamped.

The apparatus further includes two ladder retention devices 110 each being adapted for association with a respective ladder stile. Each retention device 110 includes a bracket 112 which is secured to the support body. The devices 110 include guides 113, 114 and 115 which in a mounted position limits movement of the ladder. Guides 113 and 114 includes rollers 116 and 117 and bearing plates 118 and 119. Guide 115 is in the form of a boss 120 having a bearing plate 121 associated therewith. The guides enable the apparatus to move along the ladder in the direction of the stiles whilst limiting substantial lateral movement of the ladder. Guides 114 and 115 can be adjusted along slots 123 and 124 in order to cater for different ladders. Guide 113 can be mounted in one of holes 125 to provide suitable position adjustment.

The support body can be drawn upwards by a flexible line in the form of lift rope 109 which is connected to a lift eye 108 in the middle of the support body to ensure even pulling force to both devices.

In the embodiment of FIGS. 4 to 9 each device further includes a clamping mechanism 137 by which the apparatus can be releasably secured to a structure such as gutter 60. In this embodiment the clamping device is adapted to be operated in a position remote from the apparatus when in use; that is the device can be operated from the ground or other surface upon which the ladder rests. The clamping mechanism 137 includes a clamp arm 138 in the form of a rod mounted to a support housing 171 on bracket 112. The position of the support housing 171 relative to bracket 112 is clearly illustrated in FIG. 4. The support housing 171 has mounting apertures 141 and 142 in opposed side walls thereof through which the clamp arm 138 can extend. The clamp arm 138 is slidably moveable relative to the housing 131 through the apertures 141 and 142. The clamp arm 138 has a clamping stop 177 mounted at one end thereof and a stop 178 at its other end. Clamping stop 177 is mounted on arm 173 which is spring loaded and can be rotated relative to clamping arm 138 for positioning of a pin in one of a series of grooves 174 in section 175 of arm 173 (see FIG. 7).

The clamp mechanism includes a releasable braking device 182 which in a braking position provides resistance to movement of the clamp arm 138 relative to the housing 171 in at least one direction. The braking device includes a braking bar 183 having an aperture 184 therein through which the clamp arm 138 passes. The braking bar 183 can adopt a braking position in which withdrawal of the clamp arm 138 from the housing 171 is resisted.

Spring 185 tends to urge braking bar 183 into a braking position in which relative movement between the clamp arm 138 and the housing 171 is resisted. A control arm 187 is adapted to engage braking bar 183 under the influence of spring 188 to urge the braking bar into a non-braking position. The control arm 187 can be held by catch element 189 as described hereinafter.

There is further provided an adjustment device 186 which is operable to enable incremental movement of the clamp arm 138 so that the stop 177 is drawn towards the housing. The adjustment device includes an actuating lever 181 arranged to cause movement of a drive link 190. Spring 191 urges the drive link 190 into a selected operating position. The clamp arm 138 passes through an aperture 193 in the drive link 190.

Figure 5:
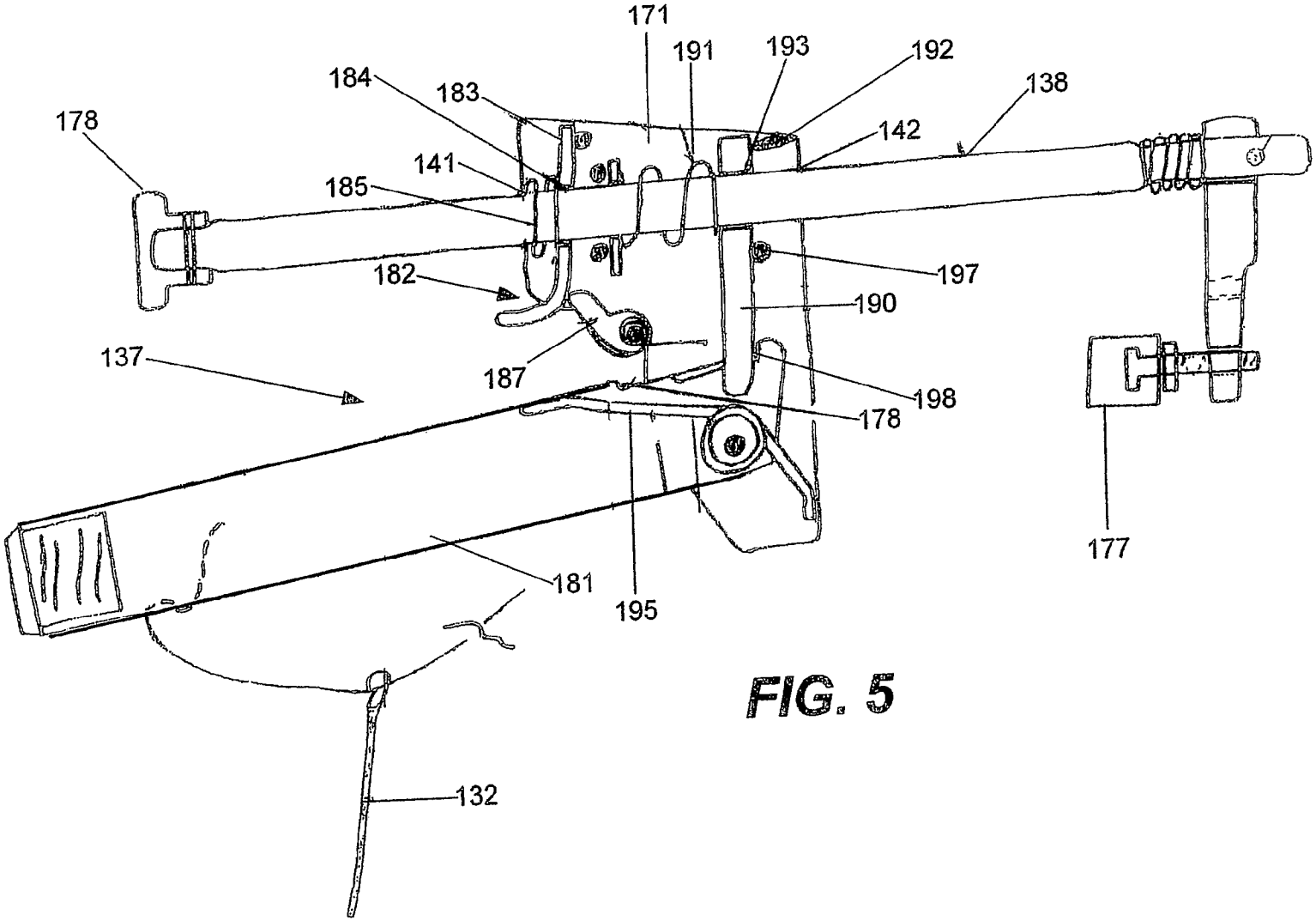
FIG. 5 is a schematic side elevation of apparatus according to one embodiment in one operating mode.

Initially the clamping mechanism adopts a pre-set mode as illustrated in FIG. 5. In this mode the actuating lever 181 is urged into a preset position by spring 195. The arrangement is such that clamp arm 138 is substantially free to move relative to braking bar 183 and drive link 190 the actuating lever 181 causing the drive link 190 to abut and be retained against lip 192 and pin 197. In this pre-set mode control arm 187 under the influence of spring 188 urges brake arm 183 into a non-braking position in which control arm 138 and can be moved in both directions relative to support housing 171. In this present mode stop 178 can be removed enabling the arm 138 to be removed and replaced. It will be appreciated the configuration of the clamp arrangement can take other forms depending upon its application. For example the arms may be of different lengths and the clamping device of different shapes for use under eaves, tree trunks, poles and the like.

When the device is required to be clamped to a structure such as gutter 60 the clamping mechanism is caused to adopt a set mode as illustrated in FIG. 6. This is done before the device is raised to the position whereby it can be clamped to the gutter. It may be put in this mode prior to or initially when mounted to the ladder. In this set mode actuating lever 181 is pivotally displaced from its pre-set position so that the control arm 187 can be moved so as to be held by catch element 189. In this position brake arm 183 is urged into a braking position under the influence of spring 185. When in this position the brake arm 183 provides a resistance to movement of the clamp arm 138 in direction where stop 177 is displaced away from supporting housing 171 although movement in the other direction is still possible.

Figure 9:
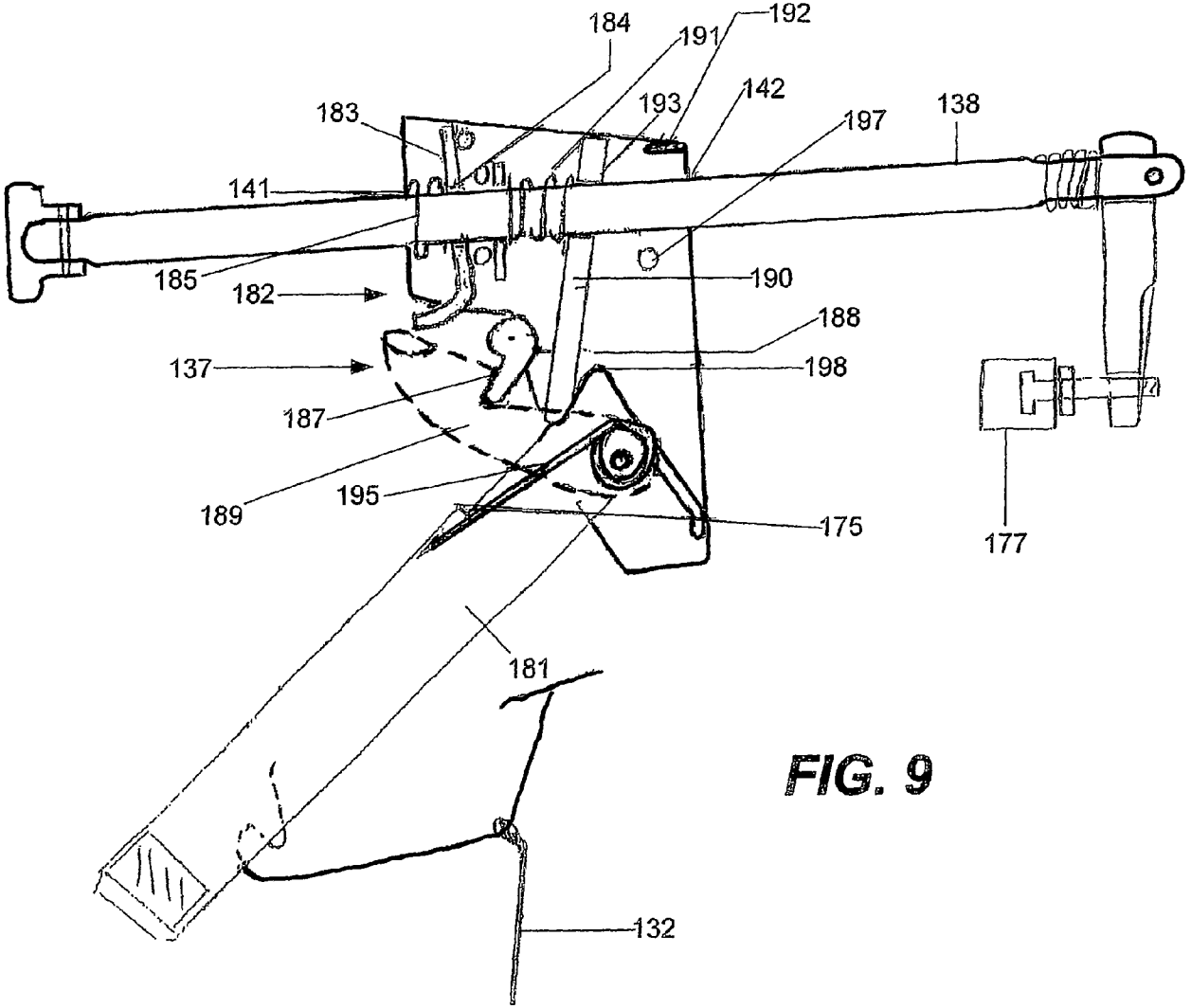
FIG. 9 is a schematic side view of the apparatus shown in another operational mode.

With the mechanism in the set mode the device can be drawn along the ladder from the base region thereof and positioned with a wall of the gutter disposed between stop 177 and the support body 102 of the device. This is illustrated in FIG. 9. Pivotal movement of actuating lever 181 causes drive link 190 to incrementally move the clamp arm 138 so that stop 177 is brought into abutment against the wall of gutter 60. Abutment section 198 causes displacement of link 190 off members 192 and 197. In this position the device firmly clamps the ladder to the gutter 60. The pivotal movement of the actuating lever can be effected from the base region of the ladder by pulling of line 132 connected thereto.

Figure 10:
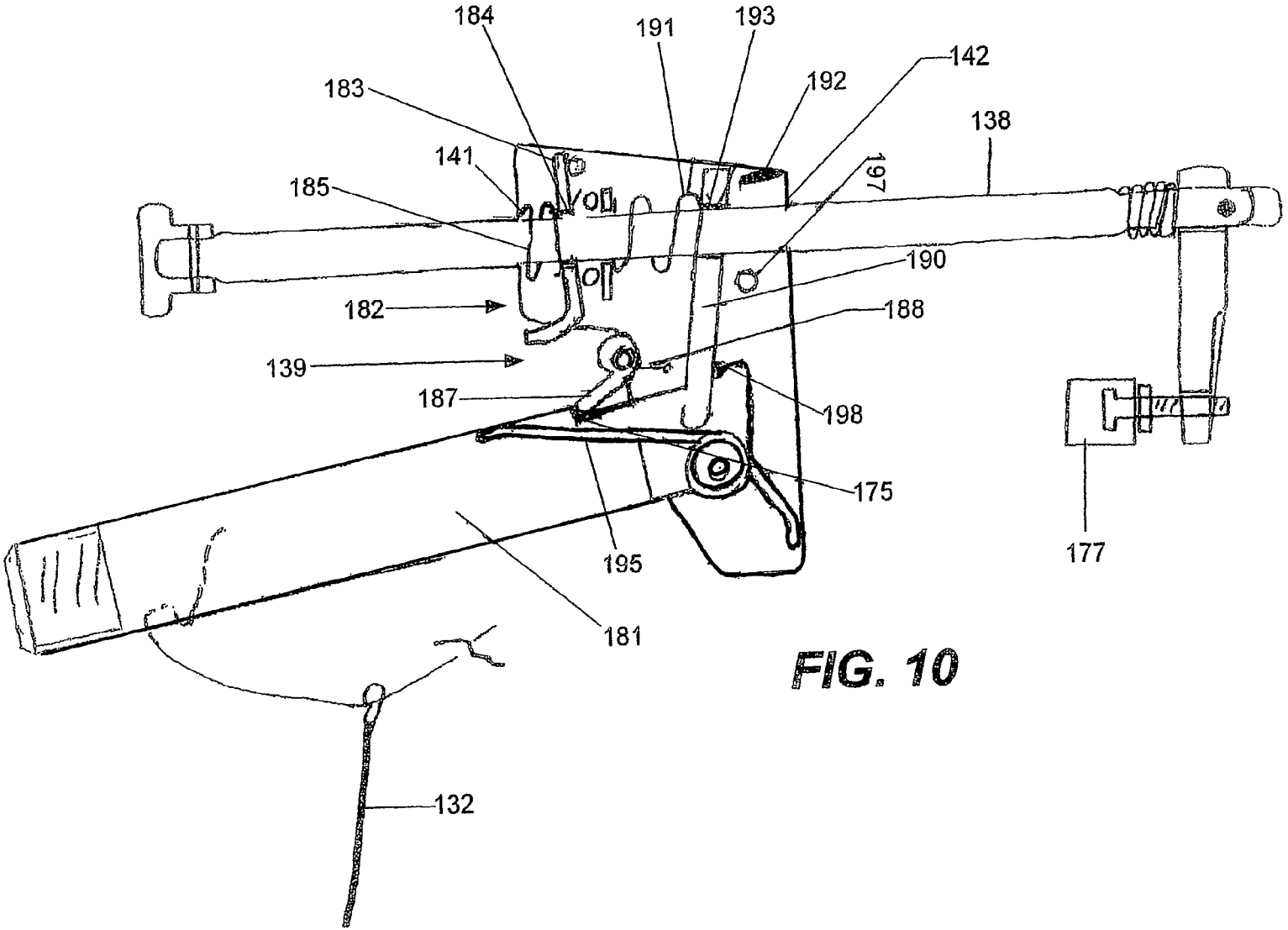
FIG. 10 is a schematic side view of the apparatus shown in another mode.

To release the device, catch element 189 is disengaged from control arm 187 which is caused to engage shoulder 175 on actuating lever 181. This is a pre-release position and is illustrated in FIG. 10. In this position the clamp arm 138 is yet to be released and the operator can descend the ladder. The abutment section 198 on actuating lever 181 causes drive link 190 to be displaced from lip 192 and pin 197 thereby effectively locking clamp arm 138 relative to the drive link 190; that it is the position of the drive link 190 which inhibits movement of the clamp arm 138 when clamped to the structure in this position. The clamp arm 138 could not move from this position even if the brake arm 183 adopted its non-braking position. By further pivotal displacement of actuating lever 181 using line 132 the control arm 187 is disengaged from the shoulder 175 on the actuating lever 181 whereupon it is caused to move under the influence of spring 188 to its pre-set position in which it acts on brake arm 183 so that it adopts the non-braking position. In this position lever 181 can move under the influence of spring 195 so that link 190 can return to the position shown in FIG. 5 and the device can be manipulated until it can be freed from the gutter whereupon it can be returned to the base position of the ladder.

Figure 14:
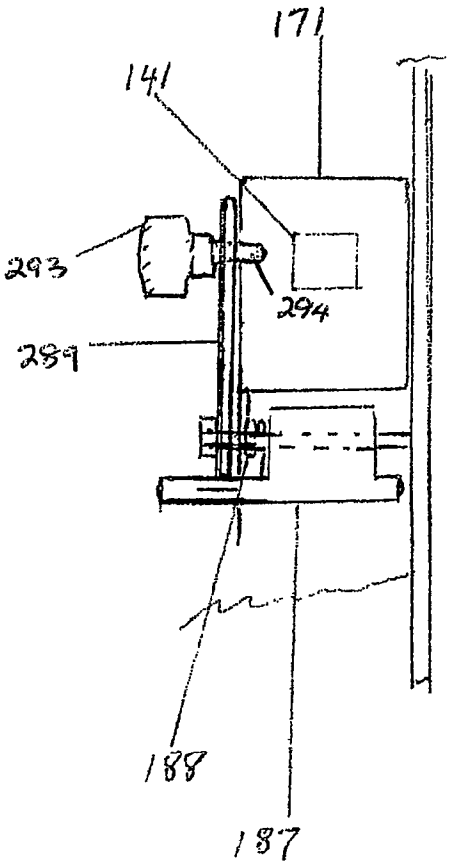
FIG. 14 is an end view of the apparatus as shown in FIGS. 11 to 13.
Figure 13:
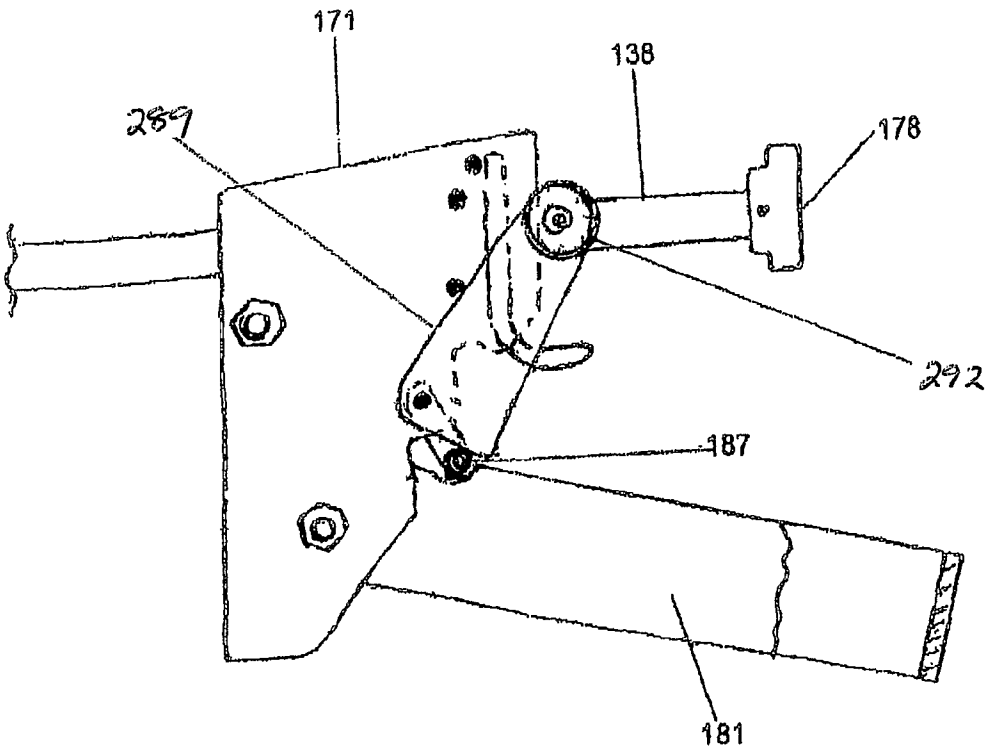
FIG. 13 is a schematic side view of the apparatus shown in FIGS. 11 and 12 in a mode of operation.
Figure 15:
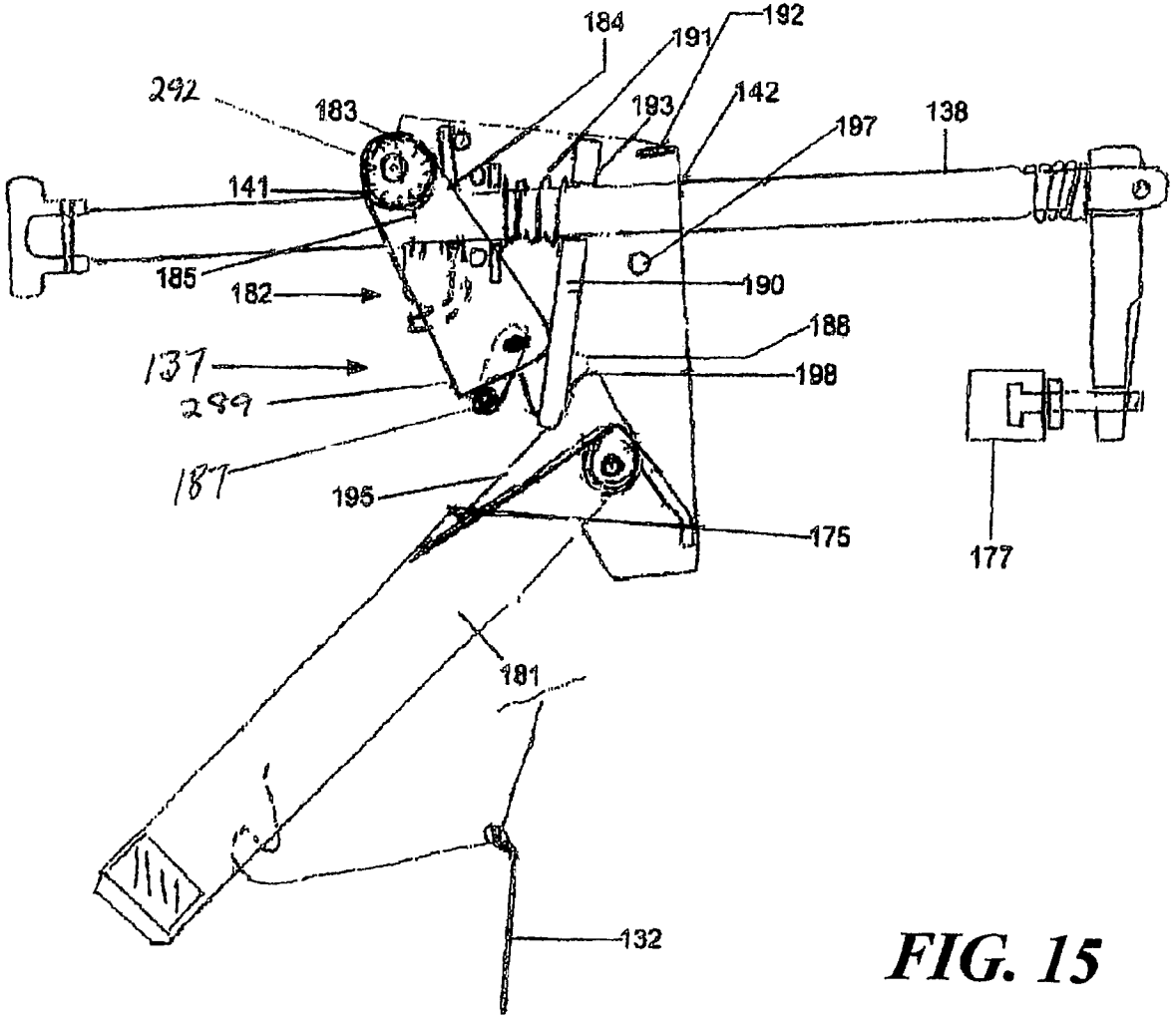
FIG. 15 is a schematic side view of the apparatus shown in FIGS. 11 to 14 in another operational mode.

Referring to FIGS. 11 to 15 there is shown another embodiment according to the invention with a modified form of catch element. The same numerals have been used to identify the same parts as shown in the earlier embodiments. In this embodiment the catch element 289 is pivotally mounted at pivot point 290 the same pivot point as for control arm 187. An indexing member 292 is provided at one end of the catch element 289. The indexing member 292 includes a knob 293 and a spring loaded pin 294 (FIG. 14).

Referring to FIG. 11 the device is shown in the preset position. In this position the spring loaded pin 294 abuts against a face of the support housing wall 171. In this position all other elements are arranged in the position as shown in FIG. 5 with reference to the first embodiment.

In order for the device to adopt the set position element 289 is rotated in the direction of arrow A in FIG. 11 until the pin under the influence of the spring associated therewith is located against the end of the housing 171 thereby preventing its return. Rotation of the element 289 into the position shown in FIG. 12 causes the control arm 187 to rotate into the position shown in FIG. 12 thereby activating braking bar 183 in the same fashion as described with reference to the first embodiment. The element 289 holds the arm 187 in the position shown in FIG. 12. Pivotal movement of lever 181 in this position causes incremental movement of the clamp arm 138 in the same manner as described with reference to the first embodiment.

To effect the pre-release position element 289 is returned to its original position but control arm 187 is retained by stop 178 on lever 181. To release the device lever 181 is pivotally displaced thereby facilitating the return of control arm 187 to its original position.

Figure 16:
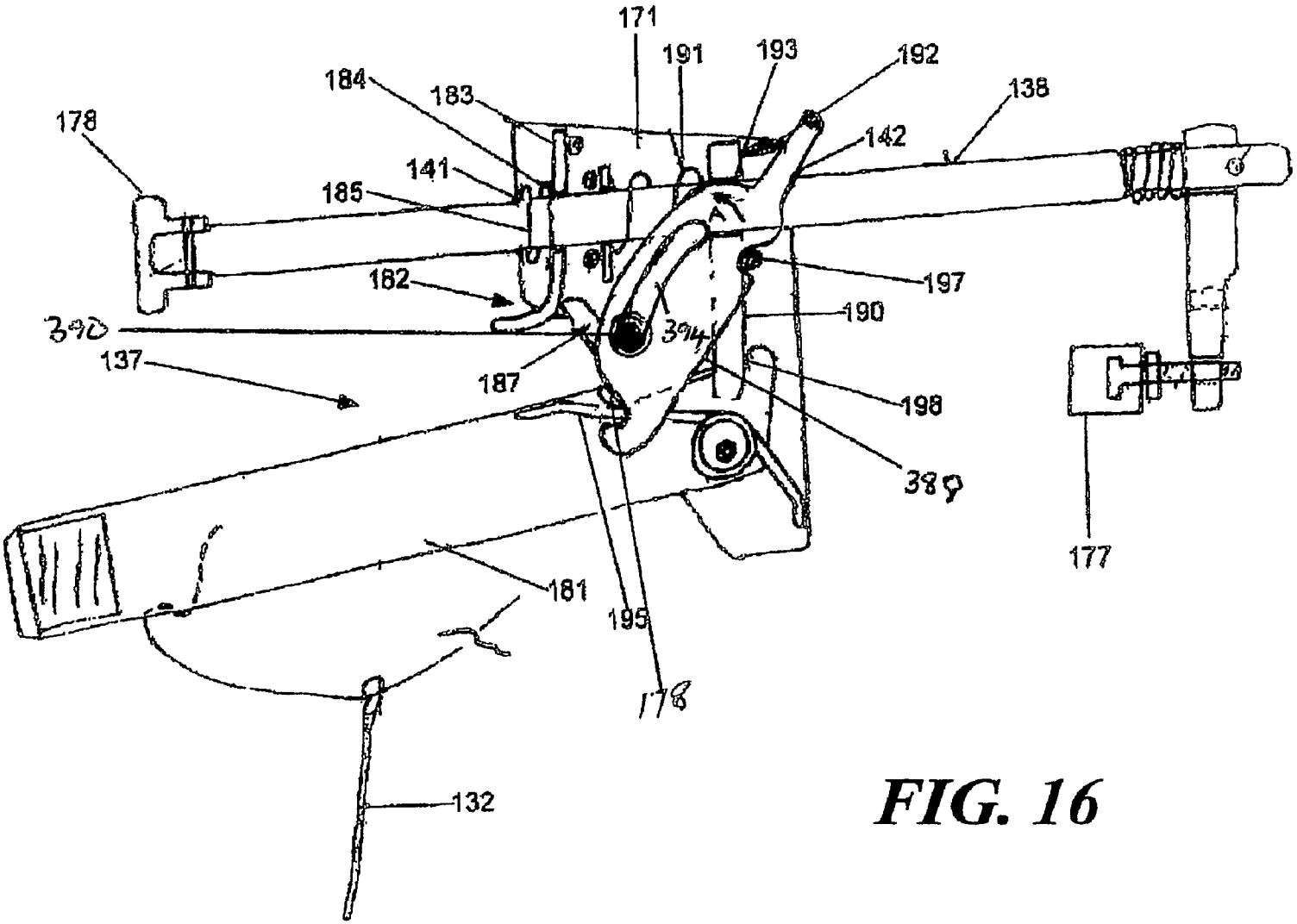
FIG. 16 is a schematic side elevation of apparatus according to yet another embodiment in one operating mode.
Figure 17:
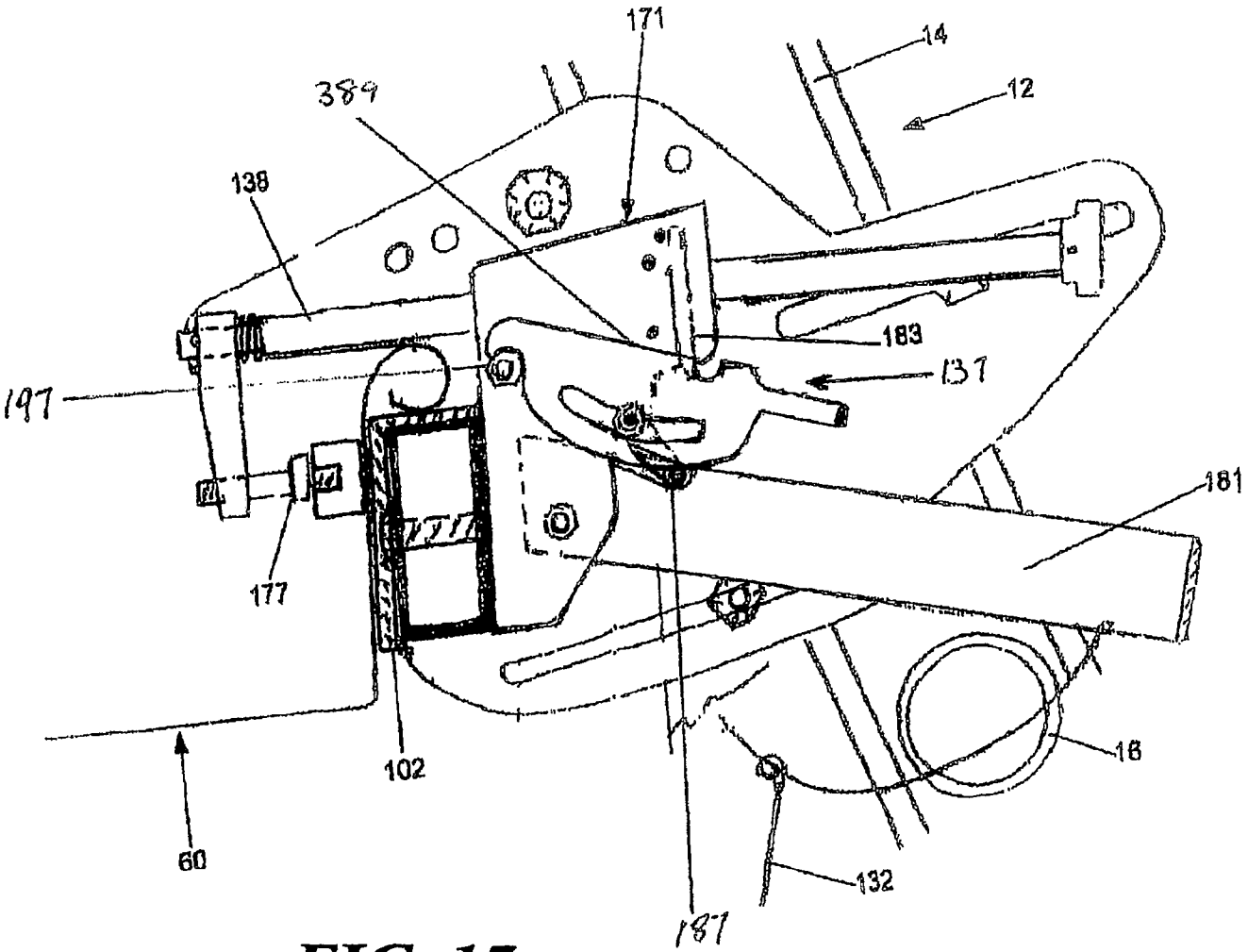
FIG. 17 is a schematic side elevation of the apparatus shown in FIG. 15 in another operating mode.
Figure 18:
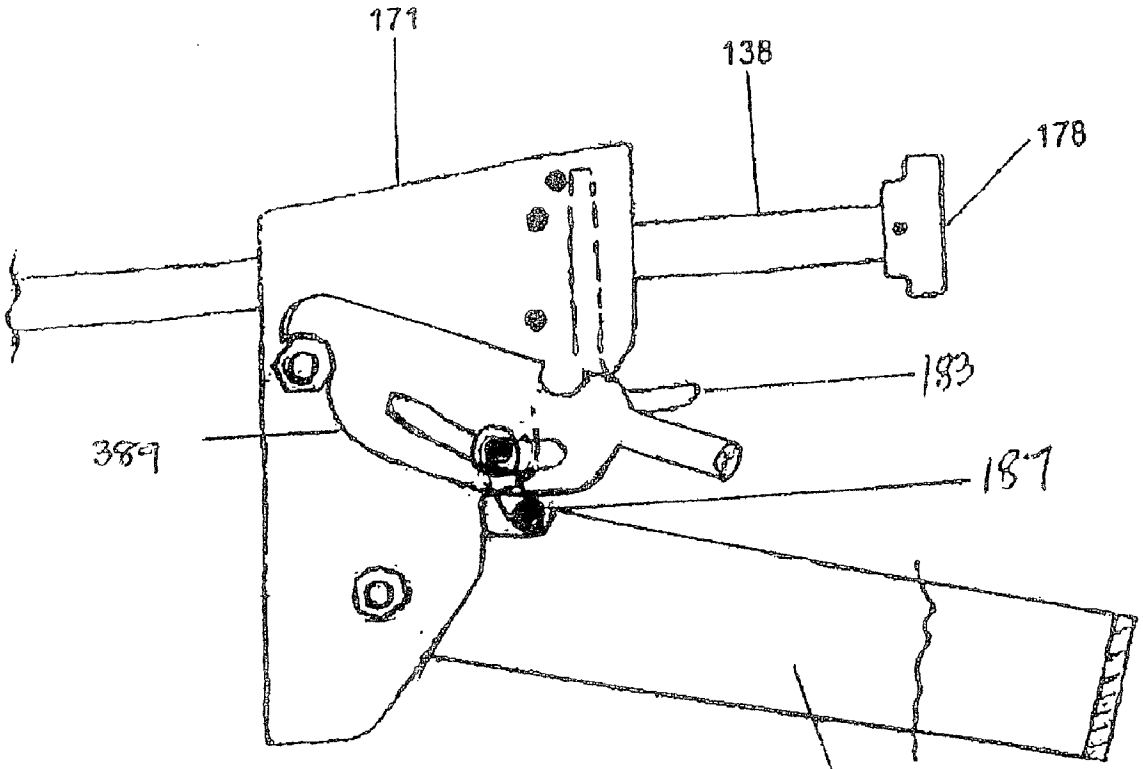
FIG. 18 is a schematic side view of the apparatus shown in FIGS. 15 and 16 in a mode of operation.
Figure 19:
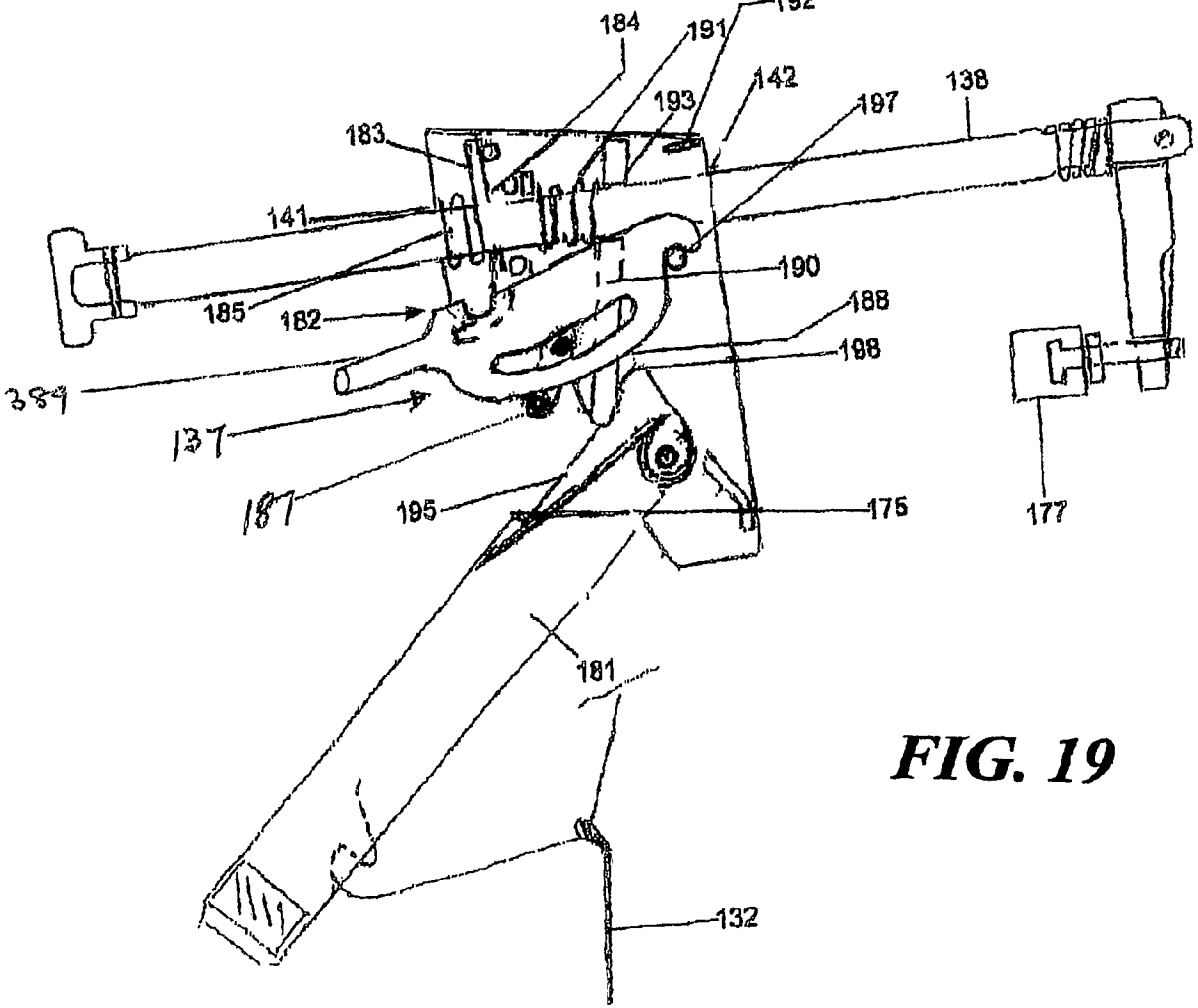
FIG. 19 is a schematic side view of the apparatus shown in another operational mode.

Referring to FIGS. 16 to 19 there is shown another embodiment according to the invention with yet a further modified form of catch element. Again the same reference numerals have been used to identify the same parts as shown in the earlier embodiments. In this embodiment the catch element 389 has a slot 394 in the element which can enable pivotal movement about pivot mount 390 as well as movement along the slot 394. FIG. 16 illustrates the device in the preset mode with the elements functioning in the same fashion as shown in FIG. 5 with reference to the first embodiment. To adopt the set position catch element 389 is pivotally moved in the direction of arrow A in FIG. 16 to the position shown in FIG. 17. The catch element 389 can lock over pin 197 on support housing 171 thereby holding the control arm 187 while actuating lever 181 is being activated to incrementally move the clamp arm 138 (FIG. 19).

Prior to descent the operator releases catch element 389 by pivotal movement thereof by releasing it from pin 197 and moving it into a forward position as shown in FIG. 16. The control arm 187 is held by stop 178 so that the mechanism is in its pre release mode. Upon descent activation of lever 181 by line 132 releases the mechanism as described earlier.

Figure 20:
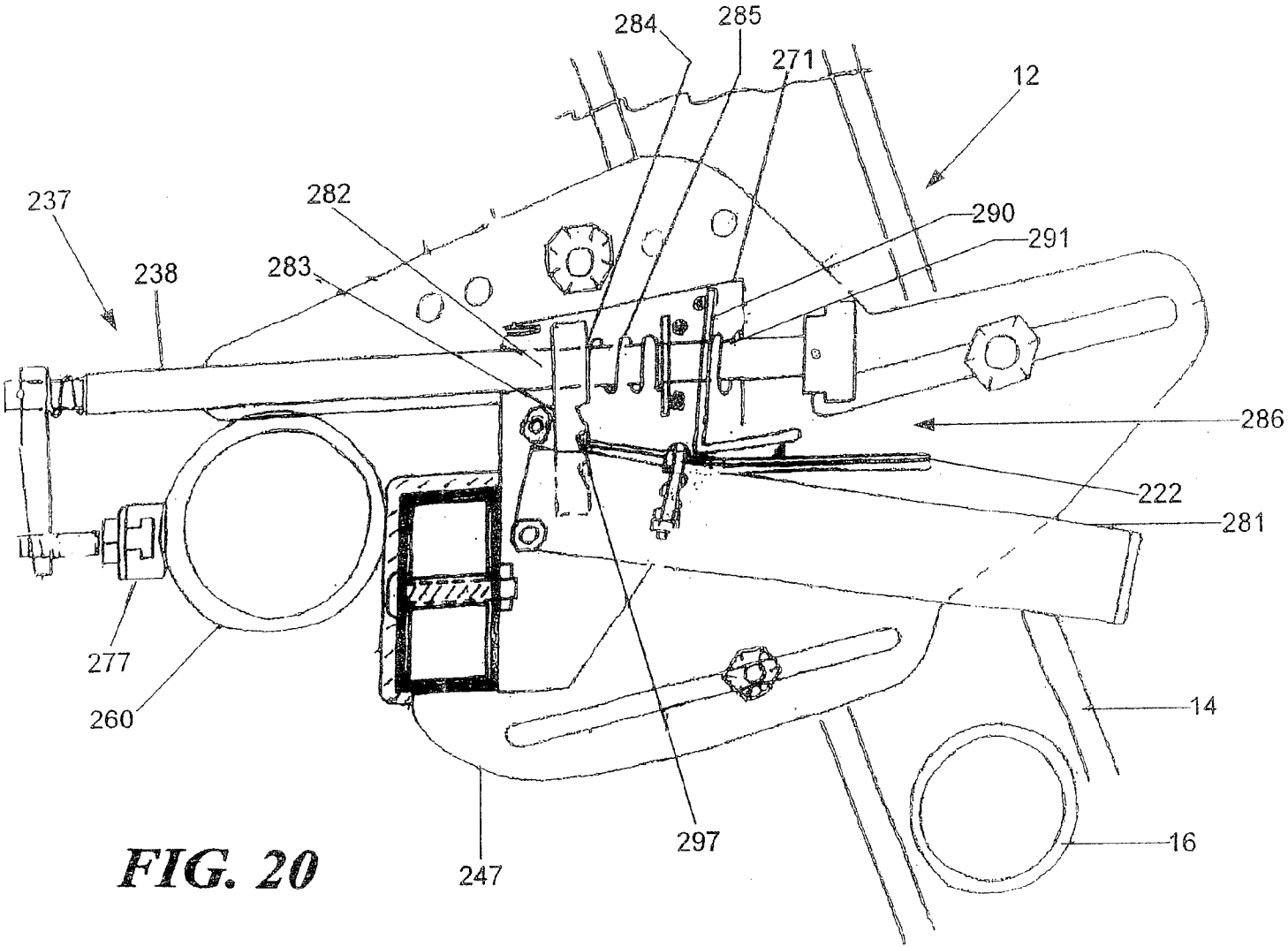
FIG. 20 is a schematic side elevation of apparatus according to yet another embodiment in one operating mode.

A manually operable apparatus is illustrated in FIG. 20. In this embodiment the clamping mechanism 237 of the apparatus can be releasably secured to scaffold member 260. The clamping mechanism 237 includes a clamp arm 238 in the form of a rod mounted to support housing 271 on bracket 247. The support housing 237 is similar in structure to that described earlier. The clamp arm 238 is mounted in a similar fashion to that described earlier. The clamp arm 238 has a clamping stop 277 at one end thereof.

The clamp mechanism includes a releasably braking device 282 which in a braking position provides resistance to movement of the clamp arm 238 relative to the housing 271 in at least one direction. The braking device includes a braking bar 283 having an aperture 284 therein through which the clamp arm 238 passes. The braking bar 283 can adopt a braking position in which withdrawal of the clamp arm 238 from the housing 271 is resisted.

Spring 285 urges the braking bar 283 into a braking position in which relative movement between the clamp arm 238 and the housing 271 is resisted in one direction.

There is further provided an adjustment device 286 which is operable to enable incremental movement of the control arm 238 so that stop 277 is drawn towards the housing. The adjustment device 286 includes an actuating lever 281 arranged to cause movement of a drive link 290. Spring 291 urges the drive link 290 into a braking position.

There is further provided a locking lever 222 which is engageable with the drive link 290 at section 294.

In the position shown in the drawing, the clamping bar is clamped to the scaffold member 260. In this position, the clamping bar is locked against movement which would loosen the clamping bars grip on the scaffold member. In order to move the clamping arm incrementally towards the scaffold member actuating lever 281 and locking lever 222 are pivotally displaced downwardly as shown in the drawing thereby causing incremental movement of the control arm 238. When the clamping arm is in the position shown in the drawing the actuating arm and locking lever are released and the locking lever engages with a tooth 297 on control arm 238. To release the mechanism firstly a slight downward pressure, is put on actuating arm 281 thereby releasing the locking lever which can be depressed so that it clears control arm 238. By then raising the actuating arm and locking lever the braking bar is caused to adopt its release position so that the clamping arm can be displaced relative to the housing.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" or "comprising", will be understood to imply the inclusion of a stated integer or step or group of integers or steps.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

The invention claimed is:

1. A ladder support apparatus, the apparatus including a support body, one or more clamping mechanisms, operatively mountable to the support body, for mounting the support body to a structure and a retention assembly operatively connected to the support body and, in use, being adapted to limit relative movement between a ladder and the support body, the or each clamping mechanism including a clamp arm mounted for movement relative to the support body in a clamping direction and a release direction, an actuating lever operable to control the operation of the clamp arm, the clamping mechanism being arranged so as to be able to adopt a preset mode in which the clamp arm is substantially freely moveable in both the clamping direction and the release direction, a set mode in which the clamp arm is resisted in either direction but can be moved incrementally in the clamping direction by operation of the actuating lever and a pre-release mode in which the clamp arm is inhibited from movement in either direction, but upon operation of the actuating lever when in the pre-release mode the clamp arm can return to the preset mode, said clamping mechanism including a brake device which in a braking position, when the mechanism is in the set mode, provides resistance to movement of the clamp arm, a control arm pivotally movable so that when the clamping mechanism is in the preset mode, the brake device is caused to adopt a non-braking position, a catch element operable to engage the control arm when in the set mode so as to hold it in the set mode, a drive link operatively associated with the control arm, and said actuating lever and said drive link operable to cause said incremental movement of said clamp arm when in the set mode.

2. A ladder support apparatus according to claim 1 wherein said retention assembly includes two ladder retention devices each adapted for association with a respective ladder stile the device including a bracket which is operatively connected to the support body and includes a plurality of guides arranged in spaced apart relation for receiving the ladder stile with which it is associated therebetween, the guides being arranged to enable relative movement between the ladder and the retention devices in the direction of the stiles, but inhibiting relative lateral movement.

3. A ladder support apparatus according to claim 2 wherein the position of the guides are adjustable relative to one another.

4. A ladder support apparatus according to claim 1 wherein each clamp arm is mounted for relative linear movement with respect to the support body, towards the support body in the clamping direction and away from the support body in the release position.

5. A ladder support apparatus according to claim 1 wherein each clamp arm can be removed and replaced with clamp arms having different clamping arrangements when the clamping mechanism is in the preset mode.

6. A ladder support apparatus according to claim 1 wherein the apparatus includes an activating element which enables the actuating lever to be activated from a base portion of a ladder with the apparatus being disposed in spaced relation from the base portion.

7. A ladder support apparatus according to claim 1 wherein said support body is an elongated member comprising a plurality of components which are arranged so that the length of the elongated member can be adjusted.

8. A ladder support apparatus according to claim 1 further including a lift mechanism operable so as to enable the apparatus to be moved along the ladder between one end region, being the base of the ladder, and the other end region of the ladder that is spaced away from the base of the ladder, the lift mechanism being operable from the base of the ladder.

9. A ladder support apparatus according to claim 8 wherein the lift mechanism includes a flexible line operatively connected to the support body and arranged to pass over a ladder rung at the other end region so that the line, when pulled, will move the apparatus along the ladder.

10. A ladder support apparatus, comprising:

a support body;

one or more clamping mechanisms, operatively mountable to the support body, for mounting the support body to a structure, each clamping mechanism having a housing;

a retention assembly operatively connected to the support body and structured such that, in use, the retention assembly is adapted to limit relative movement between a ladder and the support body;

a clamp arm connected to each clamping mechanism and mounted for movement relative to the support body between a clamping direction and a release direction;

an actuating lever operable to control the operation of the clamp arm;

a brake device structured to provide resistance to movement of the clamp arm when the brake device is engaged in a braking position when the clamping mechanism is in the set mode;

a control arm pivotally attached to the housing of the clamping mechanism and being movable so that when the clamping mechanism is in the pre-set mode, the brake device is caused to adopt a non-braking position;

a catch element positioned and operable to engage the control arm when the clamping mechanism is in the set mode so as to hold the control arm in the set mode; and a drive link connected to the housing and operatively associated with the control arm, said drive link and said actuating lever being operable to cause incremental movement of said clamp arm when in the set mode, wherein the clamping mechanism is arranged so as to be able to adopt a preset mode in which the clamp arm is substantially freely moveable in both the clamping direction and the release direction, a set mode in which movement of the clamp arm is resisted in the clamping direction and the release direction but can be moved incrementally in the clamping direction by operation of the actuating lever, and a pre-release mode in which the clamp arm is inhibited from movement in either the clamping direction or the release direction, but upon operation of the actuating lever when in the pre-release mode, the clamp arm can return to the preset mode.

* * * * *